US012655850B2

(12) United States Patent
Yang et al.

(10) Patent No.: US 12,655,850 B2
(45) Date of Patent: Jun. 16, 2026

(54) TURBOMOLECULAR PUMP

(71) Applicant: Detect-Ion LLC, Tampa, FL (US)

(72) Inventors: Wei Yang, Minnetonka, MN (US); Jorge Martinez, New Port Richey, FL (US); Ashish Chaudhary, Odessa, FL (US)

(73) Assignee: Detect-Ion LLC, Tampa, FL (US)

( * ) Notice: Subject to any disclaimer, the term of this patent is extended or adjusted under 35 U.S.C. 154(b) by 26 days.

(21) Appl. No.: 18/631,191

(22) Filed: Apr. 10, 2024

(65) Prior Publication Data

US 2025/0320875 A1 Oct. 16, 2025

(51) Int. Cl.

| | |
|---|---|
| ***F04D 19/04*** | (2006.01) |
| ***F04D 29/056*** | (2006.01) |
| ***F04D 29/08*** | (2006.01) |
| ***F04D 29/10*** | (2006.01) |

(52) U.S. Cl.

CPC ..... *F04D 19/042* (2013.01); *F04D 29/056* (2013.01); *F04D 29/083* (2013.01); *F04D 29/102* (2013.01)

(58) Field of Classification Search

CPC .. F04D 29/181; F04D 19/042; F04D 13/0606; F04D 25/0606; F04D 13/0653; F04D 29/40

See application file for complete search history.

(56) References Cited

U.S. PATENT DOCUMENTS

| | | | | |
|---|---|---|---|---|
| 4,180,370 | A * | 12/1979 | Klatt | F04D 25/04 415/111 |
| 4,787,829 | A * | 11/1988 | Miyazaki | F04D 19/048 417/423.4 |
| 5,152,679 | A * | 10/1992 | Kanemitsu | F04D 19/048 417/423.4 |
| 5,542,825 | A * | 8/1996 | Perrillat-Amede | F04D 19/04 417/423.4 |
| 6,158,986 | A * | 12/2000 | Casaro | F04D 25/064 417/423.4 |
| 6,332,752 | B2 | 12/2001 | Ikegami et al. | |
| 6,454,547 | B1 * | 9/2002 | Kohlhaas | F04D 3/02 417/423.1 |
| 7,278,822 | B2 | 10/2007 | Stanzel | |
| 8,246,300 | B2 * | 8/2012 | Shi | F04D 29/542 415/55.1 |
| 10,634,152 | B2 | 4/2020 | Behnke et al. | |

(Continued)

FOREIGN PATENT DOCUMENTS

| | | | |
|---|---|---|---|
| EP | 3628873 | B1 | 9/2020 |
| JP | S57212395 | A | 12/1982 |

*Primary Examiner* — Anthony Ayala Delgado
(74) *Attorney, Agent, or Firm* — Kevin J Fournier
Intellectual Property Legal Services Ltd; Kevin J Fournier

(57) ABSTRACT

A turbomolecular pump including a stator. The stator includes a mounting base, stator walls connected with the mounting base, and a channel that extends between the stator walls and through the mounting base. The turbomolecular pump includes a motor positioned within the channel. The motor includes a shaft, a rotator connected with the shaft, and a stem that fixedly connects the rotator and the mounting base. The turbomolecular pump includes a rotor that encloses the rotator, shaft, and a portion of the stem, and the rotor is configured to rotate relative to the stator to drive fluid flow through the channel towards the mounting base.

20 Claims, 2 Drawing Sheets

(56) References Cited

U.S. PATENT DOCUMENTS

| | | | |
|---|---|---|---|
| 10,844,864 | B2 | 11/2020 | Milner |
| 2005/0013710 | A1 | 1/2005 | Stanzel |
| 2011/0176910 | A1 | 7/2011 | Schroeder et al. |

* cited by examiner

TURBOMOLECULAR PUMP

STATEMENT REGARDING FEDERALLY SPONSORED RESEARCH

This invention was made with government support under grant no. HQ00342390001 awarded by the U.S. Department of Defense. The government has certain rights in the invention.

TECHNICAL FIELD

This disclosure relates to a turbomolecular pump configured to be used with sensitive analytical devices.

BACKGROUND

For some analytical devices, such as mass spectrometers, to properly function, turbomolecular pumps are configured to create a high vacuum in the analytical devices. The vacuum may also serve to pull fluid samples through analytical columns and into the analytical devices where compounds in the fluid samples are identified. The turbomolecular pumps function by activating a motor to rotate a rotor relative to a stator which causes fluids to flow from a low pressure area to a high pressure area. Many efforts have been made to arrange rotors and stators such that sufficient rotations per minute can be achieved and subsequent desirable vacuum levels are achieved. However, issues have arisen with undesirable vibrations while rotating, chemical contamination from bearing placement, and providing adequate arrangements for providing power.

Accordingly, what is needed are one or more techniques to solve these issues.

SUMMARY

In one aspect, the present disclosure provides a turbomolecular pump including a stator. The stator includes a mounting base, stator walls connected with the mounting base, and a channel that extends between the stator walls and through the mounting base. The turbomolecular pump includes a motor positioned within the channel. The motor includes a shaft, a rotator connected with the shaft, and a stem that fixedly connects the rotator and the mounting base. The turbomolecular pump includes a rotor that encloses the rotator, shaft, and a portion of the stem, and the rotor is configured to rotate relative to the stator to drive fluid flow through the channel towards the mounting base.

In some aspects, the turbomolecular pump may include a bearing system positioned between the stem and the rotor. The bearing system may include an adaptor that is fixed to the rotor and a bearing connected with adaptor and the stem such that the rotor is rotatable about the stem. The bearing system may be free of contact with the mounting base. The stator and the rotor may each include fins that form and maintain a high vacuum. The shaft and the rotor may have a connection that is fluidly sealed. The rotor may include a frontal wall that has a connection with the shaft that is fluidly sealed and rotor walls that enclose sides of the rotator and are aligned with the stator walls. The rotator and the rotor may be free of contact.

In another aspect, the present disclosure provides for a turbomolecular pump that includes a rotational assembly. The rotational assembly includes a stator that defines a channel. The rotational assembly includes a rotor positioned within the channel that interfaces with the stator to drive fluid flow through the channel. The rotational assembly includes a motor enclosed by the rotor and connected with the rotor at a shaft. The turbomolecular pump includes a stem that connects the motor and the stator.

In some aspects, the stem may connect with a stationary base of the motor and the shaft connects with rotator of the motor. The stem may extend from the stationary base along later walls of the motor so that the motor is stabilized as the motor rotates the shaft and the rotor. The shaft and the rotor may have a connection that is fluidly sealed at the shaft and the rotor, and the rotor may drive fluids from a high pressure opening that is adjacent to the shaft to a low pressure opening that is adjacent to the stem. The turbomolecular pump may include a wire that extends through the stem and provide power to the motor. The motor and the stem may be connected at a location adjacent to a bearing system. The bearing system may include an adapter connected with rotor and a bearing connected with the stem and the adapter so that the rotor is rotatable about the motor.

In one aspect, the present disclosure provides for a turbomolecular pump including a rotational assembly. The rotation assembly includes a stator that defines a channel with an entry and exit opening and a rotor positioned within the channel that interfaces with the stator to drive fluid flow from the entry opening to the exit opening. The turbomolecular pump includes a motor partially enclosed by the rotor, connected with the rotor at a shaft, and connected with the stator at a stem. The turbomolecular pump includes a bearing system connected with the stator at the stem.

In some aspects, the rotor may include a frontal wall that connects with the shaft and moves fluids from the frontal wall, across lateral sides of the rotor, and towards the stem. The bearing system may include an adaptor that is fixed to the rotor and a bearing connected with adaptor and the stem so that the rotor is rotatable about the stem. The rotor and bearing system may in combination enclose the motor. The rotor and the stator may each include opposing fins that are configured to drive fluids as the rotor rotates about the motor.

The present application provides techniques to stabilize the rotor of a turbomolecular pump and minimize undesirable interactions between the bearing system/motor and other components of the turbomolecular pump.

A rotor of the turbomolecular pump encloses the motor and moves fluids through a channel from a front to a back end of the rotor, where a bearing system is included. By having the rotor enclose the motor at the front of the turbomolecular pump and a bearing system downstream, undesirable contamination of the analytical devices from greases or oils of the bearing system or motor is minimized.

The turbomolecular pump includes a stem supporting a motor through a fixed connection and a rotor through a rotatable connection, and as the rotor rotates from movement of a shaft connected with the motor, the rotor is supported at two rotational points. By being connected to both the shaft and stem, the rotor and motor configuration allows for higher rotations per minute without undesirable high levels of vibrations, which may negatively impact pump performance.

The bearing system includes an adapter that is connected or integrated with portions of the rotor and the stem and a bearing between the portions of the adapter. Because the adapter provides or allows rotatable connection between the stem and the rotor, the bearing reduces vibrations from the rotor by providing rotatable support at the stem while limiting or damping the radial movements of the rotor. The bearing can optionally be comprised of materials that are free of greases or oils of the bearing system or motor that may undesirably interact with the fluids being drawn through the channel of the turbomolecular pump.

The motor of the turbomolecular pump is enclosed from the channel where fluids flow by a configuration of the rotor, bearing system, and stem. The stem can include one or more wires and optical cables within the stem that is configured to provide power and signal connections to the enclosed motor such that the turbomolecular pump is operable without having undesirable fluid interactions with the bearing system or motor. By having power and signal connections that runs through the stem, the motor can remain enclosed, the rotor can be supported at two separate points, and the turbomolecular pump can operate at high speeds in a compact formation without undesirable vibrations.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The explanations and illustrations presented herein are intended to acquaint others skilled in the art with the disclosure, its principles, and its practical application. Accordingly, the specific aspects of the present disclosure as set forth are not intended as being exhaustive or limiting of the claims. The scope of the claims should, therefore, be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present techniques provide for a compact turbomolecular pump that has improved stabilization by utilizing a configuration of a rotor enclosing a motor and supported by a stabilization bearing. The rotor is rotatably connected to a stem, which is fixed to the motor, and the rotor is fixed on a shaft of the motor that is configured to rotate relative to the motor. Since the rotor and motor are both supported by the stem, the rotor can rotate through motion of the shaft at a front of the rotor and rotate about a bearing system at a back of the rotor such that high rotation speeds can be achieved by the rotor without undesirable vibration because the rotor at both the front and back ends are supported. Further, because the rotor encloses the motor at the front end of the rotor and the bearing system is positioned at the back end of the rotor, chemical contamination through desorption of the molecules in the grease or oils of the bearing system or motor is reduced or eliminated. Additionally, the stem includes a wire or other power source that is configured to provide power to the motor that is enclosed by the rotor such that the motor is operable without negatively impacting rotation capabilities or causing vibrational impacts while rotating.

Figure 1:
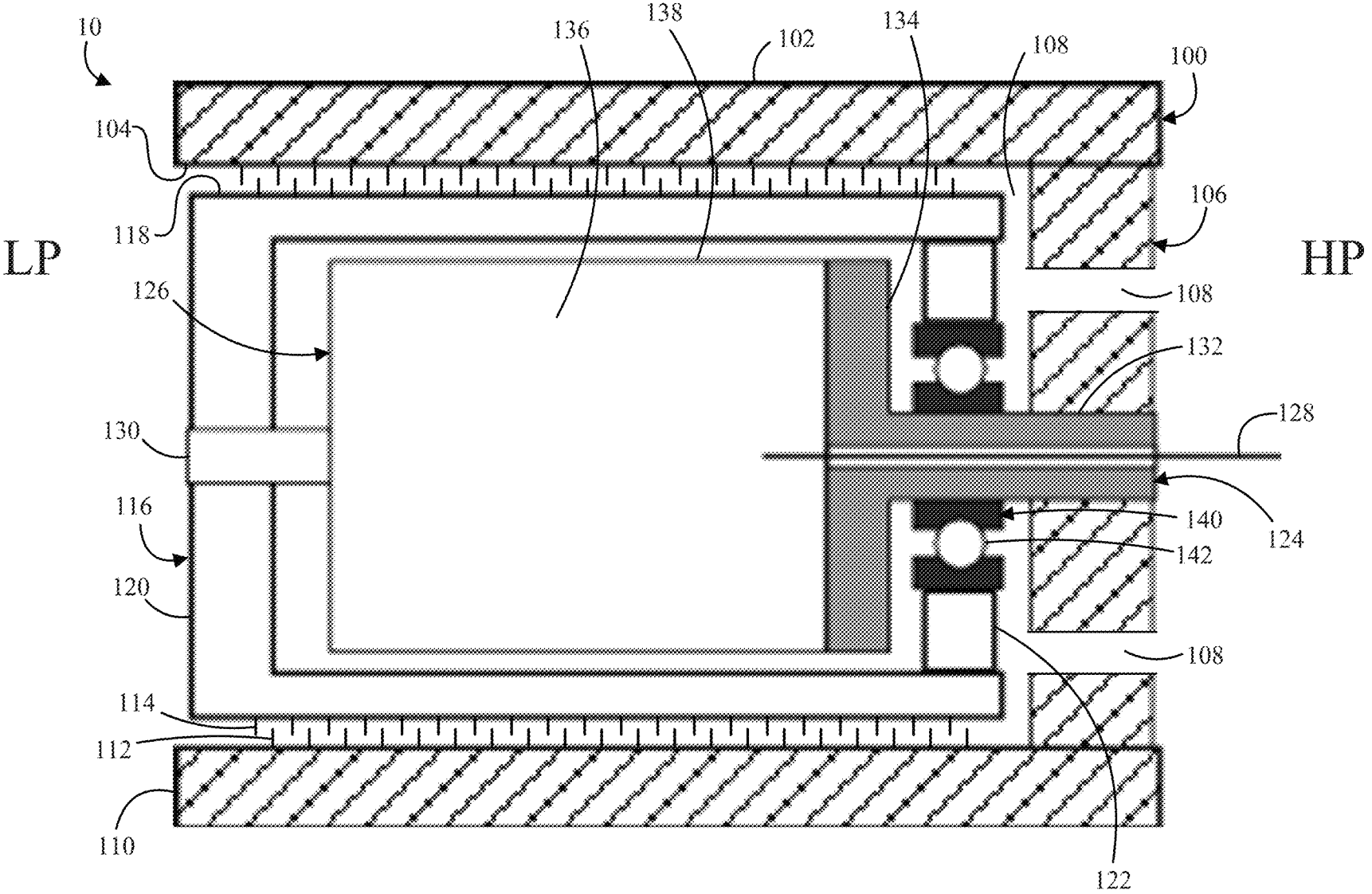
FIG. 1 is a cross-sectional view of a turbomolecular pump.

FIG. 1 is a cross-sectional view of a turbomolecular pump 10. The turbomolecular pump includes a stator 100 that is configured as a housing or body for other components of the turbomolecular pump 10. The stator 100 includes at least one stator wall 102 having an inner surface 104. At the inner surface 104 (or at another surface of the lateral wall 102), a mounting base 106 is attached to the lateral wall 102 and is positioned and arranged to define a channel 108 in conjunction with the lateral walls 102 so that fluids can travel from the low pressure area LP at an entry opening located upstream in the channel 108 to the high pressure area HP at an exit opening located downstream in the channel 108. The mounting base 106 may be a separate component that is connected with the stator 100 through welding, fasteners, adhesive, or any other connection means, or the mounting base may be an integrated portion of the stator 100 to provide a contiguous part with desirable stability properties.

The low pressure area LP is adjacent to a front wall 110 of the stator walls 102 that defines an opening (i.e., low pressure opening) to the channel 108 so that fluids can flow to one or more openings defined within the mounting base 106 at the high pressure area HP. The low pressure area LP may have a pressure of about $10^{-6}$ Torr to about 1 Torr. To facilitate fluid flow, stator and rotor fins 112, 114 interact when a rotor 116 rotates relative to the stator wall 102. As the rotor 116 rotates, the stator and rotor fins 112, 114 draw fluids through the channel 108 and towards the high pressure area HP. The high pressure area HP may be a pressure that is higher than the low pressure area LP such that fluid flow moves from the low pressure area LP to the high pressure area HP.

The stator and rotor fins 112, 114 may have any arrangement sufficient to draw fluids through the channel 108 at a desirable speed and create a desirable pressure differential between the high and low pressure areas HP, LP. For example, each of the stator and/or rotor fins 112, 114 may be spaced a distance from an adjacent stator and/or rotor fins 112, 114 of about 0.01 mm to about 0.125 mm. The stator and/or rotor fins 112, 114 are offset from opposing stator and/or rotor fins 112, 114 such that fluids can be drawn by rotating the rotor 116. The stator and/or rotor fins 112, 114 may extend at an angle relative to surfaces of the rotor 116 and/or stator 100 sufficient to allow for desirable fluid flow through the channel 108. The angle of the stator and/or rotor fins 112, 114 may be a substantially perpendicular angle relative to surfaces of the rotor 116 and/or stator 100. The substantially perpendicular angle of the stator and/or rotor fins 112, 114 may be within about 0.00001 degrees to about 1 degree degrees of a 90 degree angle relative to surfaces of the rotor 116 and/or stator 100. The stator and/or rotor fins 112, 114 may have a length sufficient to allow rotation relative to the opposing walls of the stator 100 and/or rotor 118 to create a desirable pressure differential between the high and low pressure areas HP, LP. The length of the stator and/or rotor fins 112, 114 may be measured along the longest cross-sectional length that extends away from the stator 100 and/or rotor 116. The length may be about 1 mm to about 10 mm. In some examples, grooves (not shown) may be formed or positioned between each of the stator and/or rotor fins 112, 114 to achieve desirable fluid flow through the channel 108 and between the high and low pressure areas HP, LP.

The external surfaces of rotor 116 are defined by lateral, front, and rear walls 118, 120, 122, and the lateral, front, and rear walls 118, 120, 122 in conjunction with the inner surface 104 of the stator 100 define the pathway of fluids through the channel 108. The channel 108 may have any configuration along the lateral, front, and rear walls 118, 120, 122 and the inner surfaces 104 sufficient to allow fluids to flow from the low pressure area LP to the high pressure area HP. As illustrated in FIG. 1, fluids flow from the front wall 120, along the inner surface 104 and the lateral wall 118, and to the rear wall 122 and mounting base 106 before reaching the high pressure area HP through the channel 108. In other examples, the fluids flow along the inner surface 104 and the lateral wall 118 and directly to an opening between the stator wall 102 and the mounting base 106 with minimal or no fluid flow along the rear wall 122 of the rotor 116.

The turbomolecular pump 10 includes a stem 124 connected with a motor 126 that is configured to rotate the rotor 116. The stem 124 has a fixed connection with the motor 126 and the mounting base 106 so that the stem 124 does not rotate relative to the mounting base 106 or the motor 126. The stem 124 includes one or more wires 128 that is integrated with the stem 124 and is configured to provide power to the motor 126 as the motor 126 is enclosed by the rotor 116. The wire 128 may extend through an opening of the stem 124 or may be integrated within the stem 124. The wire 128 may connect with one or more power sources (not shown) located within or external of the turbomolecular pump. The stem 124 or stator 100 may, with or without wire 128, serve as conductors to deliver power to the motor.

The motor 126 may have any configuration sufficient to rotate the rotor 116 relative to the stator 100 and cause fluids to flow from the low pressure area LP to the high pressure area HP. In this example, the motor 126 includes a shaft 130, which may be rotated by any actuating means (e.g., see, rotator 136) of the motor 126, that is fixedly connected to the rotor 116 so that the rotor 116 rotates as the shaft 130 rotates from rotation movement of the motor 126. The connection between the shaft 130 and the rotor 116 may be airtight or fluidly sealed such that the fluids do not flow between the connection of the shaft 130 and the rotor 116. In other words, the connection between the shaft 130 and the rotor 116 separates the space between the rotor 116 and motor 126 from the pathway of fluids in the channel 108.

The connection may be airtight or fluidly sealed by having or positioned a contiguous material between the shaft 130 and rotor 116. For example, the connection between the rotor 116 and shaft 130 may include an adhesive, fastener, or weld configured to seal the connection between the rotor 116 and the shaft 130 and avoid desorption as fluids move from the low pressure area LP through the channel 108 and to the high pressure area HP. By having a fixed connection between the shaft 130 and the rotor 116 and eliminating a bearing at the low pressure area LP of the turbomolecular pump 10, chemical contamination from the motor 126 and/or bearing is mitigated or eliminated because fluids drawn at the front wall 120 of the rotor 116 lack greases or oils that may be undesirably up taken in the fluids through desorption. The rotor 116 and the motor 126 are spaced apart by a distance sufficient to allow desirable rotation by the rotor 116 relative to the stator 100, such as a distance of about 0.100 mm to about 1.75 mm. Except the shaft 130, every portion of the motor 126 may be free of contact with the rotor 116. As fluids flow through the channel 108 from the front wall 120 towards the rear wall 122, fluids minimally or do not pass through the space between the rotor 116 and the motor 126 at a front wall 120 of the rotor 116.

The stem 124 extends from the mounting base 106 by an extension 132, which includes the wire 128, to a stem base 134 that contacts the motor 126. The stem base 134 has a fixed connection with the rotator 136 of the motor 126 at motor walls 138. The motor walls 138 are configured to and/or arranged around the rotator 136 in any desirable formation or shape such that the rotator 136 is supported as the rotator 136, actuates to move the shaft 130, and subsequently rotates the rotor 116 relative to the stator 100 and the motor 126. The rotator 136 may include any components sufficient to allow for desirable rotation of the shaft 130 and/or rotor 116. For example, the rotator 136 may include one or more of electromechanical conversion motors, permanent magnet motors, or any other rotator commonly known in the art.

At the extension 132, a bearing system 140 provides a rotatable connection between the rotor 116 and the stem 124 such that the rotor 116 is rotatable about the stem 124 and the stem 124 supports the lateral and rear walls 118, 122 so that the rotor 116 does not undesirably vibrate during rotation. The bearing system 140 includes a bearing 142 and the rear wall 122 positioned between the extension 132 of the stem 124 and the mounting base 106. By the rotor 116 having a fixed connection at the shaft 130 and a rotatable connection at the bearing system 140 and stem 124, the rotor 116 is supported at two points and/or both ends such that the undesirable vibrations are avoided.

The rear wall 122 includes internal and external portions that are configured to connect the rotor 116 and the and the bearing 142 to mitigate friction as the rotor 116 to rotates about the extension 132. The internal portion of the rear wall 122 is in contact with the extension 132 such that the bearing 142 is physically separated from or free of contact with the extension 132. The rear wall 122 may be configured as a low density and high heat conductivity material that is configured to withstand high rotation at the bearing 142. The rear wall 122 may be composed of aluminum, stainless steel, nickel, plastics, ceramic, or any combination thereof. The rear wall 122 and the bearing 142 may be free of grease or oils such that inadvertent interactions of chemicals with the fluids passing through the channel 108 is avoided. The rear wall 122 may be described as an adapter that bridges the rotor 116 and the bearing 142 and/or stem 124 such that undesirable vibrations are reduced during rotation.

The bearing 142 functions to allow for rotation of the rotor 116 about the extension 132. The bearing 142 may be composed of any material or components sufficient to constrain relative motion of the rotor 116 about the stem 124 and to reduce friction at the rotatable connection of the stem 124 and the rotor 116. For example, the bearing 142 may be a roller bearing, ball bearing, plain bearing, flexure bearing, needle bearing, fluid bearing, magnet bearing, taper bearing, cylinder bearing, angular contact bearings, or any combination thereof. The bearing system 140 may include a single bearing 142 (see e.g., FIGS. 1-2) or multiple bearings 142 or bearing systems 140 that connect the extension 132 and the rear wall 122. The bearing system 140 may be positioned at any location along the extension 132 that allows support and rotation of the rotor 116.

The extension 132 may extend into and/or be integrated with the stator 100 sufficiently to support the motor 126 and rotor 116 to allow for high speed rotations of the rotor 116 relative to the stator 100 and avoid undesirable vibrations during high speed rotations. For example, a first portion may extend into and/or be integrated within the stator 100, and a second portion may extend from the stator 100 to the motor 126. The second portion may be sufficiently long to allow for positioning of the rotor 116 and the bearing system 140 along the extension 132. The first and second portions in total may have a length sufficient to support the motor 126, such as about 20 mm to about 100 mm. The first and second portions may have a length ratio sufficient to support the motor 126 and rotor 116, as the rotor 116 lacks a connection with another supporting element at the front wall 120. The length ratio of the first and second portions of the extension 132 of about 1:1 to about 10:1. The length of the extension 132 may be impacted by the relative diameter of the extension 132. For example, a larger diameter of the extension 132 may allow for a smaller length ratio of the extension 132.

The extension 132 may be affixed to the stator 100 by any means sufficient to stabilize and balance the stem 124 while the motor 126 is in operation. For example, the extension 132 may extend through portions of the mounting base 106, stator 100, or other housing components of the turbomolecular pump 10 and be affixed by a fastener, weld, adhesive, or any combination thereof. In some examples, the stem 124 includes threading (not shown) at a distal end that is inserted into the stator 100 and is affixed within the turbomolecular pump 10 via a fastener (e.g., a locking nut) that is configured to stabilize the stem 124 and avoid movement during operation of the motor 126. Using threading and a faster for the extension 132 may be useful to preassemble or precalibrate the motor 126, rotor 116, and bearing system 140 before assembling with the stator 100 or to easily change out the motor 126, rotor 116, and bearing system 140 for another assembly.

The extension 132 connects with the motor 126 at the stem base 134 of the stem 124. The stem base 134 may have any connection with the motor 126 sufficient to minimize or eliminate vibrations as the rotor 116 rotates about the stem 124. For example, the stem base 134 may be connected to the motor 126 by fasteners, a weld, adhesive, or any combination thereof. The stem base 134 may extend along a portion of or an entire contiguous surface of the motor 126 such that vibration is minimized as the motor 126 operates. The stem base 134 may have a diameter that is sufficiently large to support and/or avoid undesirable vibration of the motor 126 and/or rotor 116. For example, the diameter along the largest cross-section of the stem base 134 may be about 1 mm to about 30 mm. The diameter ratio of the stem base 134 and the extension 132 may be a ratio sufficient to allow desirable rotation of the rotor 116 and minimize vibrations of the rotor 116 and motor 126. The diameter ratio of the stem base 134 and extension 132 may be about 1 mm to about 20 mm.

Figure 2:
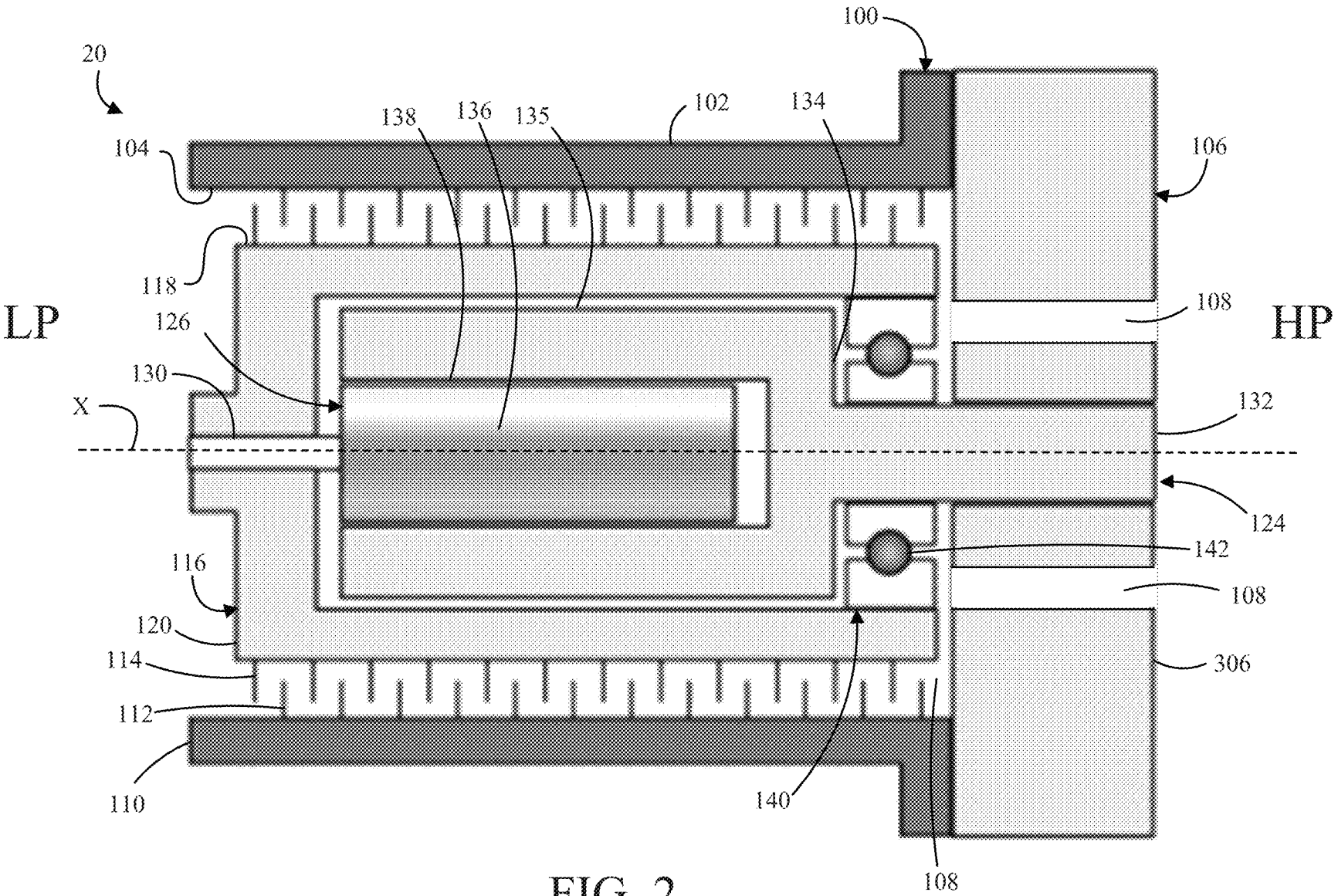
FIG. 2 is a cross-sectional view of a turbomolecular pump.

FIG. 2 is a cross-sectional view of another turbomolecular pump 10. The turbomolecular pump 10 may be similar to the turbomolecular pump 10 described in relation to FIG. 1. The turbomolecular pump 10 includes a stator 100 having stator walls 102 that define inner surfaces 104 of the stator 100. At a high pressure area HP, a mounting base 106 is connected with the stator walls 102 such that a channel 108 is formed that runs between a low pressure area LP and the high pressure area HP. The low pressure area LP is located at a front wall 110 of the stator 100, and the stator and/or rotor fins 112, 114 are configured to draw fluids from the low pressure area LP at the front wall 110 to the mounting base 106 and out of the turbomolecular pump 10.

Within the channel 108, a rotor 116 is configured to rotate relative to the stator 100 such that the fluids are drawn from the low pressure area LP to the high pressure area HP. The rotor 116 includes lateral and front walls 118, 120 that in combination with inner surfaces 104 and mounting base 106 define portions of the channel 108. Within the channel 108, the rotor 116 is connected with a stem 124 and motor 126, and the motor 126 is enclosed by rotor 116. The motor 126 is rotatably connected with the rotor 116 via a shaft 130 that is fixed to the rotor 116 by an airtight connection so that fluids only travel within the channel 108.

The stem 124 includes an extension 132 that extends between the mounting base 106 and a stem base 134 so that the motor 126 is connected with the stator 100. The stem base 134 in combination with supports 135 enclose a rotator 136 of the motor that is configured to control rotation of the shaft 130. The stem base 134 and/or the supports 135 in combination balance and stabilize the motor 126 as the shaft 130 and rotor 116 rotate relative to the stator 100 about the rotation axis X. Any portion of the supports 135 and/or stem base 134 may be secured to the motor walls 138 by adhesive, fasteners, welding, or a combination thereof such that the motor 126 is sufficiently supported while rotating the shaft 130 and the rotor 116. The support 135 may extend along an entire or portions of a lateral motor wall 138 depending on how much balancing is desired for the particular motor 126. For example, the support 135 may extend from the stem base 134 along motor walls 138 to a distal end of the motor 126 that is adjacent to the shaft 130. In some examples, the support 135 may extend along a portion of the motor wall 138, such as about 5 percent to about 95 percent of the total length of the motor wall 138.

At a connection of the stem 124 and the rotor 116, a bearing system 140 is configured to allow the rotor 116 to rotate about the extension 132 of the stem 124 and the rotation axis X. The rotor 116 is configured to rotate along a rotation axis X that extends through the shaft 130, which directs rotational motion of the rotor 116. The stem 124 is aligned with the shaft 130 along the rotation axis X. With the combination of the bearing system 140 and the fixed connection at the shaft 130, the rotor 116 is physically supported at both the front and rear end along the rotation axis X, and the bearing system 140 allows for high rotational speeds with little or no vibration.

The bearing system 140 is configured to both physically support the back end of the rotor 116 to avoid unsupported vibration at high rotation speeds and to reduce friction between the rotor 116 and the extension 132 as the rotor 116 rotates. In the example of FIG. 2, the rotor 116 does not include a back wall or adapter (see e.g., the rear wall 122 of FIG. 1), and the bearing system 140 connects the lateral wall 118 and the extension 132 so that the rotor 116 is supported while rotating. So that the rotor 116 rotates properly along the rotational axis X, the diameter of the largest cross-section of the bearing system 140 may be substantially the same as the diameter of the front wall 120.

The channel 108 may be defined by at least three portions that each are located at areas of different pressure. A first portion of the channel 108 may be defined by the area within or adjacent to the low pressure area at the front walls 110, 120 and may have a pressure that is substantially the same as the low pressure area LP. The second portion of the channel 108 may be defined between the inner surface 104 and the lateral wall 118 and may be configured to mechanically draw fluids from the first portion to the third portion by rotating the rotor and stator fins 112, 114 relative to each other. The third portion of the channel 108 may be defined between portions of the mounting base 106 and/or the bearing system 140 at or adjacent to the high pressure area and may have a pressure that is higher than a pressure of the low pressure area LP. In combination, the first, second, and third portions move fluids toward the high pressure area HP.

The rotor 116 may be configured to rotate about the rotation axis X at a rotation speed sufficient to create a desirable pressure difference between the low pressure area LP and high pressure area HP. The rotation speed may be about 0 rotations per minute to about 200,000 rotations per minute. The rotation speed may be adjusted based on the desired application of the turbomolecular pump 10. For example, different separation columns and analytical devices may utilize different rotation speeds so that desirable molecule separation and analysis is achievable.

The rotor 116 may have a diameter along the largest cross-section of the rotor 116 that is sufficiently large to enclose a desirable motor 126 and/or to have a desirable space between the lateral wall 118 and the inner surface 104. The cross-section of the rotor 116 may be sufficiently sized such that the rotor and stator fins 112, 114 create a desirable pressure difference between the high and low pressure areas HP, LP. The rotor 116 may have a diameter sufficient to integrate with a particular bearing system 140. For example, the rotor 116 may have a diameter of about 10 mm to about 100 mm.

The channel 108 may have a cross-sectional diameter between the lateral and frontal walls 118, 120 or bearing system 140 and the inner surface 104 or mounting base 106 sufficient to allow desirable fluid flow from the low pressure area LP to the high pressure area HP. For example, the lateral wall 118 and the inner surface 104 may be spaced by a distance of about 1 mm to about 10 mm. For example, the bearing system 140 may be spaced from the mounting base 106 by a distance of about 0.1 mm to about 1 mm. Each of the rotor 116, the inner surface 104 of the stator 100, and the stem 124 may be substantially cylindrical such that desirable rotation during operation is achieved. The rotor and stator fins 112, 114 may extend along cylindrical surfaces of the lateral wall 118 and the inner surface 104 in a substantially circular and/or spiral pattern.

The turbomolecular pumps 10 described herein are configured to connect with one or more analytical devices at the low pressure area LP.

At the front walls 110, 120, the turbomolecular pump 10 may be connected with an appropriate separation column and any analytical devices that operate in low pressure environment. Separation columns may include any column commonly known in the art such as typical gas chromatography columns. Analytical devices may include mass spectrometry, or any combination thereof. By having a turbomolecular pump 10 that can achieve high rotations with low vibrations and/or chemical contamination, shorter separation columns are usable with more sensitive analytical instruments to achieve desirable separation and detection of a wide spread of molecules in a fluid sample. Fluids as described herein may refer to compounds or combination thereof that are liquid and/or gaseous at ambient temperature (i.e., 25 degrees). Grease or oils as described herein may include chemicals utilized in motors and/or bearing systems that are dissolvable in fluids moving through the channel. The rotor 116 and stator 100 may in combination be described as a rotation assembly that is configured to draw fluids from the low pressure area LP to the high pressure area HP.

Any numerical values recited in the above application include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value, and the highest value enumerated are to be considered to be expressly stated in this application in a similar manner. Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

In a first example of an embodiment, a turbomolecular pump includes a stator comprising a mounting base; stator walls; and a channel that extends between the stator walls, an inlet, and an outlet; a motor positioned within the channel comprising a shaft; a rotator connected with the shaft; and a stem that fixedly connects the rotator and the mounting base and is at least partially exposed to the channel; and a rotor that is rotationally supported by the stem and the shaft, is enclosed by the stator walls within the channel, encloses the rotator, shaft, and a portion of the stem, and is configured to rotate relative to the stator to drive fluid flow between the inlet and the outlet.

In the first example, the turbomolecular pump may include a bearing system positioned between the stem and the rotor and separates the portion of the stem enclosed by the rotor and a different portion of the stem that is exposed to the channel.

In the first example, the bearing system may include an adaptor that is fixed to the rotor, and a bearing connected with adaptor and the stem such that the rotor is rotatable about the stem.

In the first example, the bearing system may include the bearing system free of contact with the mounting base.

In the first example, the stator and the rotor may each include fins that may be configured to form and maintain a high vacuum.

In the first example, the shaft and the rotor may have a connection that may be fluidly sealed so that fluids do not flow between an internal surface of the rotor and the rotator.

In the first example. the rotor may include a frontal wall that has a connection with the shaft that may be fluidly sealed; and rotor walls that enclose sides of the rotator and may be aligned with the stator walls.

In the first example, the rotator and the rotor may be free of contact.

In a second example of an embodiment, a turbomolecular pump includes a rotational assembly, comprising: a stator that defines a channel; and a rotor enclosed within one or more stator internal surfaces of the stator, positioned within the channel, and configured to rotationally interface with the stator to drive fluid flow through the channel; a motor enclosed by one or more rotor internal surfaces of the rotor, separated from the channel by the rotor, and fixedly connected with the rotor at a shaft; and a stem that connects with the motor, wherein the rotor is connected with and configured to rotate about the stem.

In the second example, the stem may connect with a stationary base of the motor and the shaft may connect with a rotator of the motor.

In the second example, the stem may extend from the stationary base along lateral walls of the motor so that the rotor may be stabilized as the motor rotates the shaft and the rotor.

In the second example, the shaft and the rotor may have a connection that may be fluidly sealed at the shaft and the rotor, and wherein the rotor may be configured to drive fluids from a low pressure opening that is adjacent to the shaft to a high pressure opening that is adjacent to the stem.

In the second example, the turbomolecular pump may include one or more wires that extends through the stem and may be configured to provide power to the motor.

In the second example, the motor and the stem may be connected at a location adjacent to a bearing system.

In the second example, the bearing system may include an adapter connected with rotor; and a bearing connected with the stem and the adapter so that the rotor is rotatable about the motor.

In a third example of an embodiment, a turbomolecular pump includes a rotational assembly, comprising: a stator that defines a channel by one or more internal stator walls with an entry opening and an exit opening; and a rotor positioned within the channel and the one or more internal stator walls and configured to rotate relative to the stator to drive fluid flow from the entry opening to the exit opening; a motor partially enclosed by one or more internal rotor walls of the rotor, connected with the rotor at a shaft, and connected with a stem; and a bearing system connected with the rotor at the stem, the bearing system that separates some of the stem from the channel.

In the third example, the rotor may include a frontal wall that connects with the shaft and may be configured to move fluids from the frontal wall, across lateral sides of the rotor, and towards the stem.

In the third example, the bearing system may include an adaptor that may be fixed to the rotor, and a bearing connected with adaptor and the stem so that the rotor may be rotatable about the stem.

In the third example, the rotor and the bearing system in combination may enclose the motor.

In the third example, the rotor and the stator may each comprise opposing fins that are configured to drive fluids as the rotor rotates about the motor.

What is claimed is:

1. A turbomolecular pump, comprising:

a. a stator comprising:

i. a mounting base;

ii. stator walls; and iii. a channel that extends between the stator walls, an inlet, and an outlet;

b. a motor positioned within the channel, comprising:

i. a shaft;

ii. a rotator connected with the shaft; and c. a stem that fixedly connects the rotator and the mounting base and is at least partially exposed to the channel; and d. a rotor that is rotationally supported by the stem and the shaft, is enclosed by the stator walls within the channel, encloses the rotator, shaft, and a portion of the stem, and is configured to rotate relative to the stator to drive between the inlet and the outlet.

2. The turbomolecular pump of claim 1, further comprising:

a. a bearing system positioned between the stem and the rotor and separates the portion of the stem enclosed by the rotor and a different portion of the stem that is exposed to the channel.

3. The turbomolecular pump of claim 2, wherein the bearing system comprises:

a. an adaptor that is fixed to the rotor, and b. a bearing connected with adaptor and the stem such that the rotor is rotatable about the stem.

4. The turbomolecular pump of claim 2, wherein the bearing system is free of contact with the mounting base.

5. The turbomolecular pump of claim 1, wherein the stator and the rotor each comprise fins that are configured to form and maintain a high vacuum.

6. The turbomolecular pump of claim 1, wherein the shaft and the rotor have a connection that is fluidly sealed so that fluids do not flow between an internal surface of the rotor and the rotator.

7. The turbomolecular pump of claim 1, wherein the rotor comprises:

a. a frontal wall that has a connection with the shaft that is fluidly sealed; and b. rotor walls that enclose sides of the rotator and are aligned with the stator walls.

8. The turbomolecular pump of claim 1, wherein the rotator and the rotor are free of contact.

9. A turbomolecular pump, comprising:

a. a rotational assembly, comprising:

i. a stator that defines a channel; and ii. a rotor enclosed within one or more stator internal surfaces of the stator, positioned within the channel, and configured to rotationally interface with the stator to drive fluid flow through the channel;

b. a motor enclosed by one or more rotor internal surfaces of the rotor, separated from the channel by the rotor, and fixedly connected with the rotor at a shaft; and c. a stem that connects with the motor, wherein the rotor is connected with and configured to rotate about the stem.

10. The turbomolecular pump of claim 9, wherein the stem connects with a stationary base of the motor and the shaft connects with a rotator of the motor.

11. The turbomolecular pump of claim 10, wherein the stem extends from the stationary base along lateral walls of the motor so that the rotor is stabilized as the motor rotates the shaft and the rotor.

12. The turbomolecular pump of claim 9, wherein the shaft and the rotor have a connection that is fluidly sealed at the shaft and the rotor, and wherein the rotor is configured to drive fluids from a low pressure opening that is adjacent to the shaft to a high pressure opening that is adjacent to the stem.

13. The turbomolecular pump of claim 9, further comprising:

one or more wires that extends through the stem and configured to provide power to the motor.

14. The turbomolecular pump of claim 9, wherein the motor and the stem are connected at a location adjacent to a bearing system.

15. The turbomolecular pump of claim 14, wherein the bearing system comprises:

an adapter connected with rotor; and a bearing connected with the stem and the adapter so that the rotor is rotatable about the motor.

16. A turbomolecular pump, comprising:

a. a rotational assembly, comprising:

i. a stator that defines a channel by one or more internal stator walls with an entry opening and an exit opening; and ii. a rotor positioned within the channel and the one or more internal stator walls and configured to rotate relative to the stator to drive fluid flow from the entry opening to the exit opening;

b. a motor partially enclosed by one or more internal rotor walls of the rotor, connected with the rotor at a shaft, and connected with a stem; and c. a bearing system connected with the rotor at the stem, the bearing system that separates some of the stem from the channel.

17. The turbomolecular pump of claim 16, wherein the rotor comprises a frontal wall that connects with the shaft and is configured to move fluids from the frontal wall, across lateral sides of the rotor, and towards the stem.

18. The turbomolecular pump of claim 16, wherein the bearing system comprises:

a. an adaptor that is fixed to the rotor, and b. a bearing connected with adaptor and the stem so that the rotor is rotatable about the stem.

19. The turbomolecular pump of claim 18, wherein the rotor and the bearing system in combination enclose the motor.

20. The turbomolecular pump of claim 16, wherein the rotor and the stator each comprise opposing fins that are configured to drive fluids as the rotor rotates about the motor.

* * * * *